US010112811B2

(12) United States Patent
Lautwein et al.

(10) Patent No.: US 10,112,811 B2
(45) Date of Patent: Oct. 30, 2018

(54) SYSTEM ARRANGEMENT OF LIFTING MECHANISMS AND METHOD OF OPERATING THE SYSTEM ARRANGEMENT

(71) Applicant: M.A.T. Malmedie Antriebstechnik GmbH, Solingen (DE)

(72) Inventors: Christof Lautwein, Friesenhagen (DE); Christoph Wagener, Geldern (DE)

(73) Assignee: M.A.T. Malmedie Antriebstechnik GmbH, Solingen (DE)

( * ) Notice: Subject to any disclaimer, the term of this patent is extended or adjusted under 35 U.S.C. 154(b) by 0 days.

(21) Appl. No.: 15/125,974

(22) PCT Filed: Apr. 16, 2015

(86) PCT No.: PCT/EP2015/058287
§ 371 (c)(1),
(2) Date: Sep. 14, 2016

(87) PCT Pub. No.: WO2016/110333
PCT Pub. Date: Jul. 14, 2016

(65) Prior Publication Data

US 2017/0305729 A1 Oct. 26, 2017

(30) Foreign Application Priority Data

Jan. 8, 2015 (DE) ..... 10 2015 100 181

(51) Int. Cl.
*B66D 1/58* (2006.01)
*B66D 1/14* (2006.01)
(Continued)

(52) U.S. Cl.
CPC ..... *B66D 1/58* (2013.01); *B66D 1/12* (2013.01); *B66D 1/14* (2013.01); *B66D 5/12* (2013.01); *B66D 2700/0166* (2013.01)

(58) Field of Classification Search
CPC ... B66D 1/12; B66D 1/58; B66D 1/26; B66D 5/12; B66D 2700/0166
See application file for complete search history.

(56) References Cited

U.S. PATENT DOCUMENTS 1,719,216 A * 7/1929 Fink ..... B66D 1/26 254/294
2,389,177 A * 11/1945 Ball ..... B66D 1/26 254/297

(Continued)

FOREIGN PATENT DOCUMENTS

CN 2341967 Y 10/1999
CN 201217623 Y 4/2009

(Continued)

OTHER PUBLICATIONS

Int'l Search Report dated Jul. 30, 2015 in Int'l. Application No. PCT/EP2015/058287.

*Primary Examiner* — Michael E Gallion
(74) *Attorney, Agent, or Firm* — Panitch Schwarze Belisario & Nadel LLP

(57) ABSTRACT

A system arrangement for the drive train of lifting mechanisms, such as crane lifting mechanisms, is disclosed. The system arrangement includes at least one drive motor (1, 1'), at least one cable drum (2, 2') connected thereto, a reduction transmission (3) arranged between the drive motor (1, 1') and the cable drum (2, 2'), an automatic overrun shutdown freewheel (6), and at least one safety brake (4, 4'). To optimize such a drive train, at least one active motor locking assembly (5, 5') is utilized to hold the load when the drive motor (1, 1') is decelerated electrically to a rotary speed of zero. The active motor locking assembly is utilized instead of at least one passive operating brake.

13 Claims, 6 Drawing Sheets

(51) Int. Cl.
*B66D 5/12* (2006.01)
*B66D 1/12* (2006.01)

(56) References Cited

U.S. PATENT DOCUMENTS

| | | | | |
|---|---|---|---|---|
| 7,891,641 | B1 * | 2/2011 | Miller | B66D 1/16 254/344 |
| 7,970,520 | B2 * | 6/2011 | Gross | B66D 1/58 212/272 |
| 2008/0140289 | A1 * | 6/2008 | Gross | B66D 1/58 701/50 |
| 2015/0097149 | A1 * | 4/2015 | Heinrichs | B66D 1/28 254/342 |
| 2015/0375975 | A1 * | 12/2015 | Flateland | B66D 1/7405 254/310 |
| 2016/0101969 | A1 * | 4/2016 | Lautwein | B66D 1/14 254/356 |
| 2016/0347593 | A1 * | 12/2016 | Golder | B66D 3/22 |
| 2017/0305729 | A1 * | 10/2017 | Lautwein | B66D 1/58 |
| 2018/0141790 | A1 * | 5/2018 | Paal | B66D 1/26 |

FOREIGN PATENT DOCUMENTS

| | | | |
|---|---|---|---|
| CN | 203624946 | U | 6/2014 |
| DE | 10 2013 209 361 | A1 | 11/2014 |
| EP | 1661845 | A1 | 5/2006 |

* cited by examiner

SYSTEM ARRANGEMENT OF LIFTING MECHANISMS AND METHOD OF OPERATING THE SYSTEM ARRANGEMENT

CROSS-REFERENCE TO RELATED APPLICATIONS

This application is a Section 371 of International Application No. PCT/EP2015/058287, filed Apr. 16, 2015, which was published in the English language on Jul. 14, 2016 under International Publication No. WO 2016/110333 A1 and the disclosure of which is incorporated herein by reference.

BACKGROUND OF THE INVENTION

The invention concerns a system arrangement for the drive train of lifting mechanisms, in particular crane lifting mechanisms, comprising at least one drive motor, at least one cable drum connected thereto, a reduction transmission arranged between the drive motor and the cable drum, an automatic overrun shutdown means, and at least one safety brake and a method of operating the system arrangement.

In a known lifting mechanism of the specified kind (EP 1 661 845 B1) there are provided two drive motors which drive two cable drums by way of a reduction transmission. Provided in the drive train, besides operating brakes and safety brakes, are overrun shutdown means which, in the event of an overload which exceeds a predetermined load, entirely or partially separate the connection between the motors and the cable drums. That is intended to ensure that the individual components of the drive train and more specifically in particular the reduction transmission are neither damaged nor ruined.

In addition a drive train for lifting mechanisms is known (DE 10 2013 209 361 A1) in which, in the case of an emergency stop braking action, damage is avoided by the provision of an automatic overrun shutdown means between the drive motor and the operating brake. The shutdown means is preferably in the form of a freewheel, wherein the freewheel represents an effective safety device if the load to be carried is lowered.

The known systems have already proven their worth in practice. The operating brakes and the safety brakes in the known drive trains are in the form of spring-closing brakes which open hydraulically, pneumatically, magnetically or electro-hydraulically. In the event of a power failure or an emergency shutdown, that has the result that the braking circuits are automatically closed. In that case each braking circuit in itself is capable of stopping the load within the predetermined parameters. The arrangement of the independent braking circuits is substantially due to the fact that on the one hand, in the event of transmission breakdown the load can no longer be stopped with the operating brakes, but on the other hand the operating brakes are required in order to hold the load in the normal case at the rotary speed '0' of the drive motors, with the linked high switching cycles. In accordance with the status at the present time the safety brakes are not suitable for high switching cycles and consequently close only in the event of transmission breakdown, power failure, emergency shutdown and the like.

However a number of problems arise due to the two braking circuits which are implemented in an emergency situation. Due to the shorter dead time firstly the safety brakes operates. In that case the masses building up due to the mass inertias of the motors and motor couplings also have to be braked. High load peaks therefore occur in the reduction transmission. In the load direction 'LOWER' the situation additionally involves load changes or tooth flank changes at the gears of the reduction transmission. Those problems can lead to serious transmission damage, in particular in the case of crane lifting mechanisms with particularly frequent shutdown situations and involving high lifting speeds. In addition, due to the operation of both braking circuits, inevitable 'over-brakings' of the lifting mechanism occur, with the resultant negative effects on the statics and other crane components.

BRIEF SUMMARY OF THE INVENTION

Therefore the object of the invention is to eliminate those disadvantages.

According to the invention that object is attained in that instead of at least one passive operating brake there is provided at least one active motor locking means for holding the load when the drive motor is decelerated electrically to a rotary speed '0'.

By virtue of the invention therefore it is possible to completely dispense with the operating brakes provided in the drive trains of known lifting mechanisms. In the case of a power failure, an emergency braking situation or a transmission breakdown the required braking operation can be implemented exclusively by the safety brakes, while in normal operation at a zero speed of the drive motors, without the need for operation of the safety brakes, the motor locking means are used to hold the load.

The motor locking means are preferably of a positively locking configuration. Alternatively however it is also possible for the motor locking means to be of a force-locking or friction-locking configuration.

In contrast to the operating brakes used hitherto the motor locking means are actively operative and are held open for example by spring force. This ensures that, in the case of a power failure, an emergency braking situation or a transmission breakdown, the motor locking means does not close automatically but, at the rotary speed '0', is actuated hydraulically or electro-hydraulically, pneumatically or magnetically.

The motor locking means can be arranged jointly with a motor coupling between the respective drive motor and the reduction transmission.

Alternatively however it is also possible for the motor locking means to be arranged on the side of the drive motor, that faces away from the motor coupling or the reduction transmission.

The drive motor can also be flange-mounted directly to the reduction transmission without the interposition of a motor coupling.

When using a motor locking means of positively locking configuration it is preferably in the form of a selector shift tooth arrangement.

To implement such a shift tooth arrangement a stator gear which projects in a direction towards the drive motor and which has an outside tooth arrangement can be arranged on the housing of the reduction transmission while arranged non-rotatably on the motor shaft or the input shaft of the transmission is a rotor gear also having an outside tooth arrangement, wherein provided for connecting or separating the motor locking means there is a shift element which is provided with an inside tooth arrangement and with which the stator gear and the rotor gear can be selectively coupled.

If the motor locking means is arranged at the rear side of the drive motor it is possible to provide on the housing of the drive motor a stator ring gear which is fixedly connected thereto and which has a face tooth arrangement operative in the axial direction while arranged on the motor shaft is a rotor ring gear which is axially displaceable thereon and which is arranged non-rotatably and which has an equivalent face tooth arrangement at the planar face thereof and which can be coupled to the stator ring gear fixedly connected to the motor housing for locking the drive motor.

In that case the rotor ring gear can be held in the uncoupled position by means of compression springs while for actuation of the motor locking means the rotor ring gear is displaced in a direction towards the stator ring gear into the coupled position.

The overrun shutdown means is preferably in the form of a freewheel. It can be integrated into the reduction transmission, in which case it is arranged selectively on the input shaft, the intermediate shaft or the output shaft of the reduction transmission.

The freewheel integrated into the transmission is permanently locked in normal operation, due to the load direction remaining the same in the lifting and lowering modes, which permits normal operation of the lifting mechanism. If in the lowering mode braking of the lifting mechanism occurs by means of the safety brakes then the rotating masses rotate freely to the freewheel so that no damage to the transmission or other components occurs. In addition as a result the braking travel of the load is also curtailed as no accelerating masses have to be also braked.

A further structural option provides that a cable drum joint connection is provided between the output shaft of the reduction transmission and the cable drum, the freewheel being integrated into the cable drum joint connection.

For additional safety the safety brakes can be divided into two independent control circuits so that there is a redundant resource as a reserve. In that way the drive train according to the invention, which is intended in particular for crane lifting mechanisms, can be still further optimised. That additional optimisation also has a particularly advantageous effect for the transport of hazardous goods.

The method according to the invention substantially provides that the motor locking means is activated immediately after the electrical deceleration of the drive motor or motors to the rotary speed '0'.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
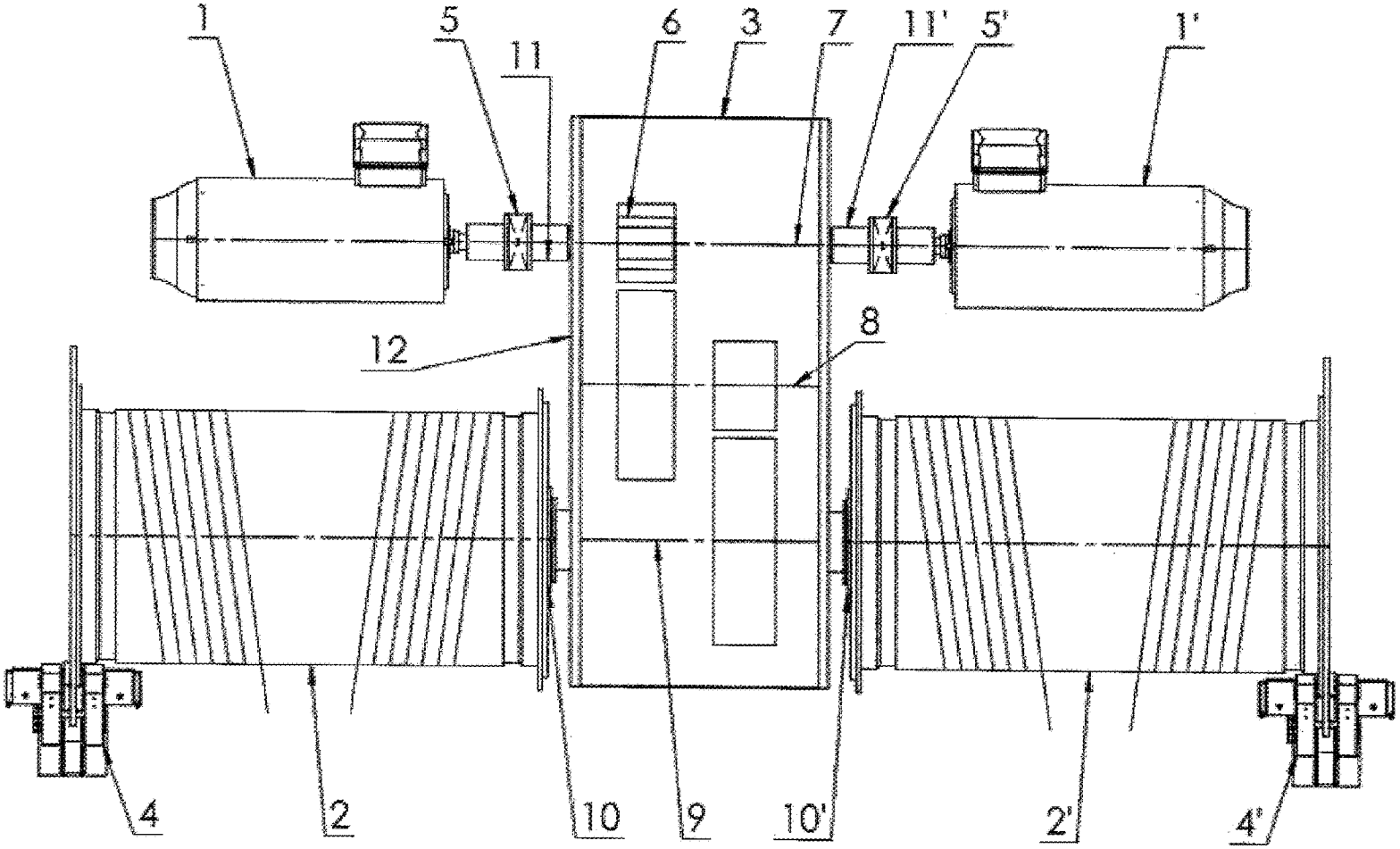
FIG. 1 shows a first embodiment of the invention.

Referring to the drawing the drive train according to the invention which is intended in particular for crane lifting mechanisms comprises two drive motors 1, 1', two cable drums 2, 2', a reduction transmission 3 disposed between the drive motors 1, 1' and the cable drums 2, 2', an automatic overrun shutdown means and two safety brakes 4, 4' fitted to the cable drums 2, 2'.

In addition the drive train according to the invention has active motor locking means 5, 5' which serve to hold the load in the event of the drive motors 1, 1' being electrically decelerated to the rotary speed '0' and which can be actively actuated. In that way it is possible to dispense with the per se known passive operating brakes normally arranged between the drive motors 1, 1' and the reduction transmission 3.

Provided as the overrun shutdown means is a freewheel 6 which, in each of the embodiments by way of example shown in FIGS. 1 to 4, is integrated in the reduction transmission 3. In the illustrated examples the freewheel 6 is arranged on the input shaft 7 of the reduction transmission 3. Alternatively however the freewheel 6 could also be arranged on the intermediate shaft 8 or the output shaft 9 of the reduction transmission 3.

In all four embodiments of the drive train according to the invention there is a cable drum joint connection 10 and 10' respectively between the output shaft 9 of the reduction transmission 3 and the respective cable drum 2 or 2'. In the structure shown in FIG. 4 the freewheel 6 is integrated in the cable drum joint connections 10 and 10' respectively.

In the embodiment shown in FIG. 1 the motor locking means 5 or 5' is arranged together with the motor coupling 11 or 11' between the respective drive motor 1 or 1' and the reduction transmission 3.

Figure 5:
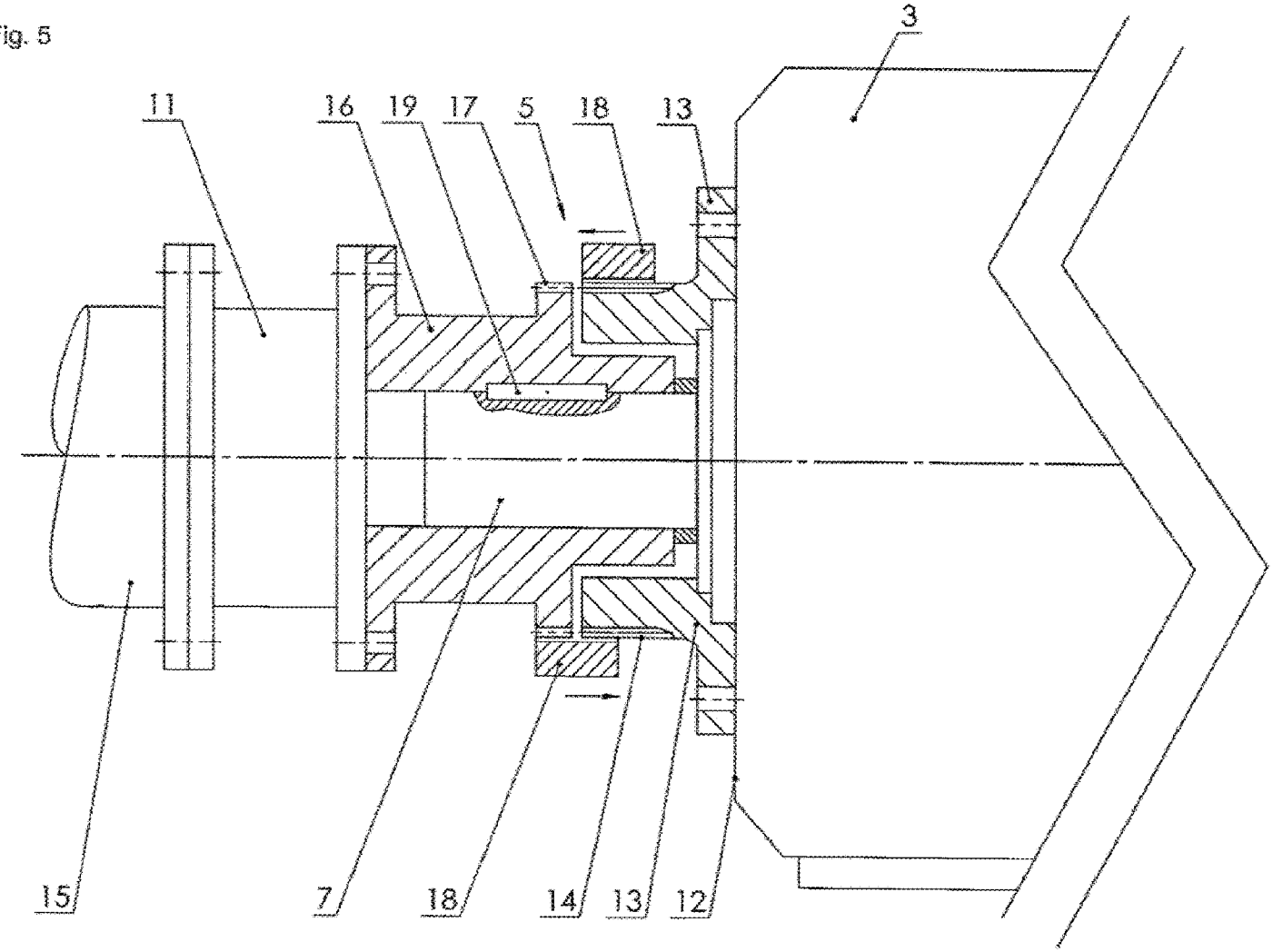
FIG. 5 shows a view on an enlarged scale of a specific configuration of the motor locking means.

FIG. 5 shows a partly sectional view on an enlarged scale of the motor locking means 5. In this embodiment the motor locking means 5 is of a positively locking configuration, more specifically in the form of a selector shift tooth arrangement. It comprises a stator gear 13 which is arranged on the housing 12 of the reduction transmission 3 and which projects from the housing 12 in the direction towards the drive motor 1 and is provided with an outside tooth arrangement 14. The shift tooth arrangement further includes a rotor gear 16 which is arranged non-rotatably on the motor shaft 15 or the input shaft 7 of the transmission and which is also provided with an outside tooth arrangement 17. A shift element 18 serves for coupling or uncoupling the two gears 13 and 16, the shift element 18 being provided with an inside tooth arrangement which fits with the outside tooth arrangements 14 and 17 of the gears 13 and 16.

In the upper part FIG. 5 shows the uncoupled condition in which the shift element 18 is carried exclusively on the stator gear 13 so that there is no connection to the rotor gear 16. In the lower part of FIG. 5 the shift element 18 extends over the outside tooth arrangements 14 and 17 of both gears 13 and 16 so that the motor shaft 15 is blocked by means of the motor locking means 5.

In the embodiment shown in FIG. 5 the rotationally fixed mounting of the rotor gear 16 is effected by way of a fitting key 19 which is fitted into corresponding grooves in the input shaft 7 of the reduction transmission 3 and the rotor gear 16. In addition the rotor gear 16 is connected non-rotatably and axially immovably to the motor shaft 15 by way of the motor coupling 11.

In operation of the lifting mechanism the shift element 18 is held in its disengaged or uncoupled position by means of spring elements (not shown in the drawing). To produce the engaged or coupled position there is applied an active force which is produced in opposite relationship to the spring force and which can be produced by the most widely varying means, for example hydraulically or electro-hydraulically, pneumatically or also magnetically.

Figure 2:
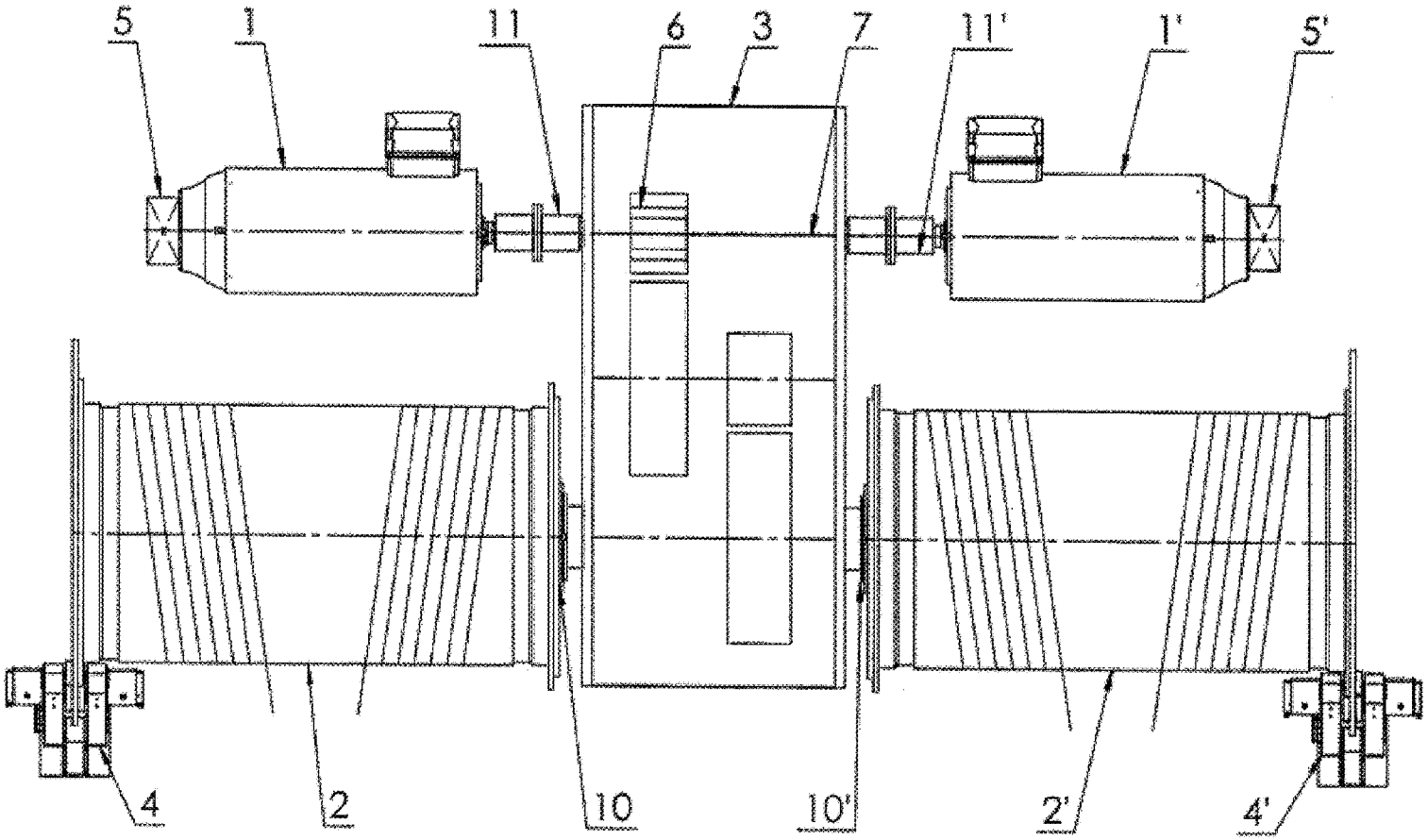
FIG. 2 shows a second embodiment of the invention.
Figure 3:
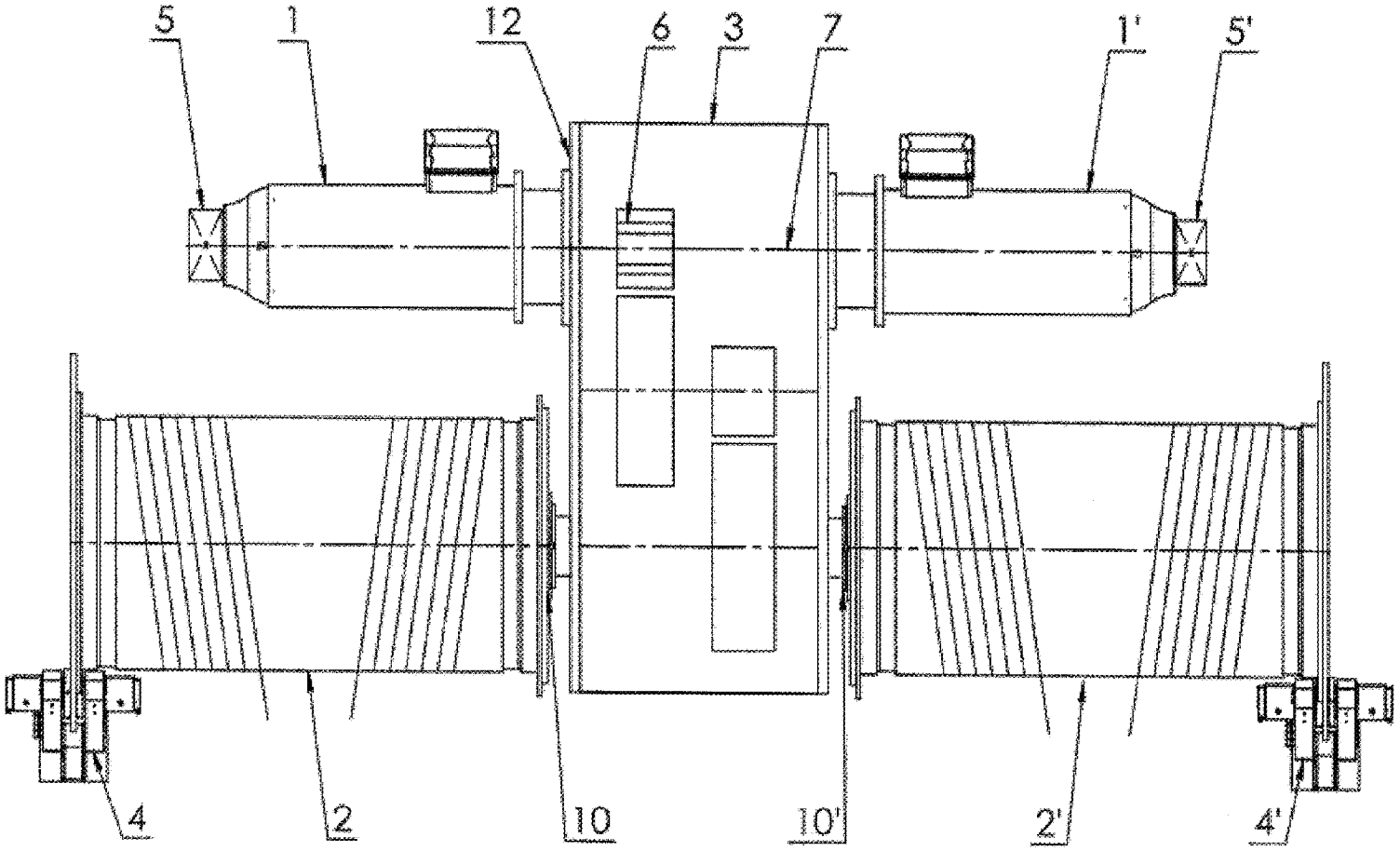
FIG. 3 shows a third embodiment of the invention.
Figure 4:
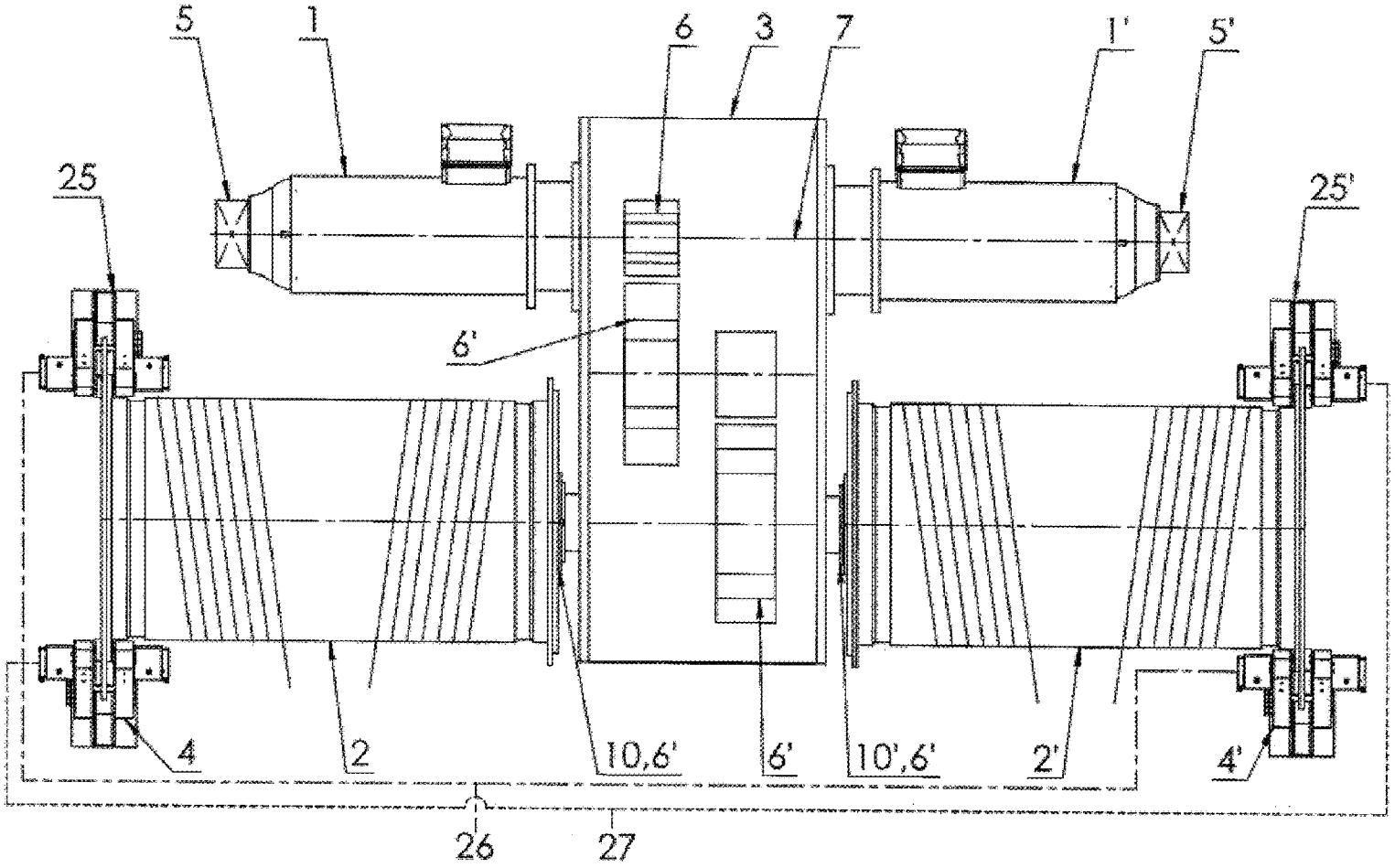
FIG. 4 shows a fourth embodiment of the invention.

In the embodiments shown in FIGS. 2 to 4 the motor locking means 5 and 5' is arranged on the side of the drive motor 1 or 1', that is remote from the reduction transmission 3.

With such a structure, as shown in FIG. 3, the drive motor 1 or 1' can be flange-mounted directly to the reduction transmission 3 without the interposition of a motor coupling 11 or 11' respectively.

Figure 6:
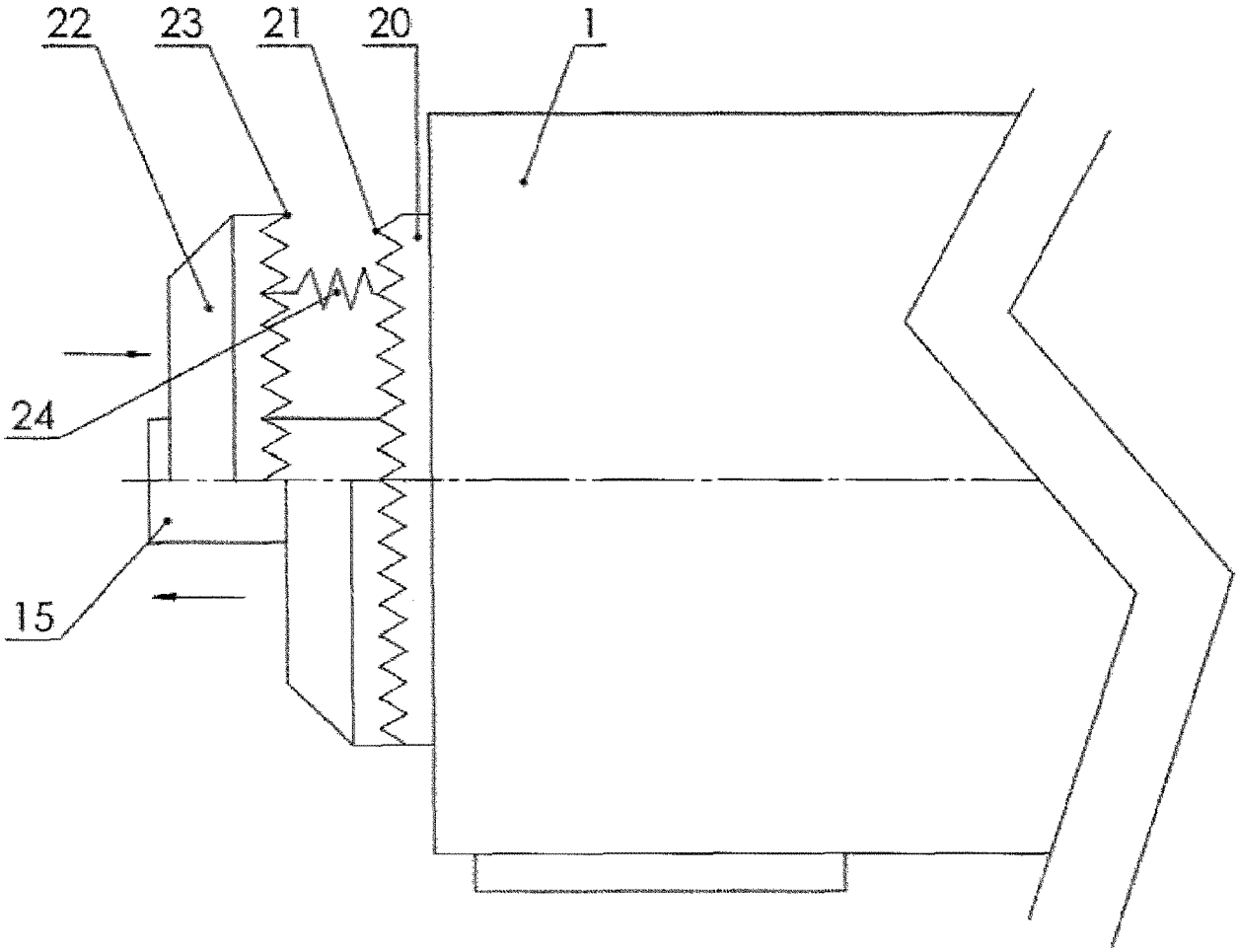
FIG. 6 shows another embodiment of the motor locking means.

FIG. 6 shows a specific configuration of this motor locking means as shown in FIGS. 2 to 4. As can be seen in detail, provided on the housing of the drive motor 1 is a stator ring gear 20 which is fixedly connected thereto and which has a face tooth arrangement 21 operative in the axial direction. Arranged on the motor shaft 15 is a rotor ring gear 22 which is displaceable axially thereon and which is arranged non-rotatably and which has an equivalent face tooth arrangement 23. The axially displaceable and non-rotational connection between the rotor ring gear 22 and the motor shaft 15 can be made by means of a fitting key or a taper profile (not shown in greater detail in the drawing).

In the upper part of FIG. 6 the two ring gears 20 and 22 are shown in the disengaged or uncoupled position. That position is produced by means of compression springs 24 which in operation of the lifting mechanism hold the two ring gears 20 and 22 apart.

In the lower part of FIG. 6 the two ring gears 20 and 22 are shown in the engaged or coupled position. To reach that locked condition there is provided an actuating device (not shown in the drawing) which presses the rotor ring gear 22 against the stator ring gear 20 in opposition to the compression springs 24. For uncoupling purposes the actuating device is moved back so that the rotor ring gear 22 is disengaged again by means of the compression springs 24.

Therefore in normal operation, at the rotary speed '0' of the drive motors 1 and 1' respectively, the load can be held by means of the motor locking means 5 and 5' without the safety brakes having to operate so that the safety brakes are not stressed with high switching cycles. The drive train according to the invention therefore not only operates more reliably and more securely but also achieves a longer service life.

In the embodiment shown in FIG. 4 there are two additional safety brakes 25, 25'. The four safety brakes 4, 4' and 25, 25' can be actuated in paired relationship by way of separate control circuits 26, 27 so that this affords a redundant resource as an additional safety aspect.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A system arrangement for lifting mechanisms comprising:

at least one drive motor (1, 1');

at least one cable drum (2, 2') connected thereto;

a reduction transmission (3) arranged between the drive motor (1, 1') and the cable drum (2, 2');

an automatic overrun shutdown freewheel (6);

at least one safety brake (4, 4'), and at least one active motor locking assembly (5, 5') to hold the load when the drive motor (1, 1') is slowed down; a stator ring gear (20) fixedly connected to a housing of the drive motor (1, 1'), the stator ring gear (20) having a face tooth arrangement (21) operative in an axial direction; and a rotor ring gear (22) non-rotatably arranged on a motor shaft (15) of the drive motor (1, 1'), the rotor ring gear (22) being axially displaceable thereon and having an equivalent face tooth arrangement (23); wherein the rotor ring gear (22) is coupleable to the stator ring gear (20) to lock the drive motor (1, 1').

2. The system arrangement of claim 1, wherein the motor locking assembly (5, 5') is a positively locking assembly.

3. The system arrangement of claim 1, wherein the motor locking assembly (5, 5') is a force-locking or frictionally-locking assembly.

4. The system arrangement of claim 1, wherein the motor locking assembly (5, 5') is hydraulically, electro-hydraulically, pneumatically or magnetically actuatable.

5. The system arrangement of claim 1, wherein the motor locking assembly (5, 5') is arranged jointly with a motor coupling (11, 11') between the drive motor (1, 1') and the reduction transmission (3).

6. The system arrangement of claim 1, wherein the motor locking assembly (5, 5') is arranged on a side of the drive motor (1, 1') facing away from the reduction transmission (3).

7. The system arrangement of claim 1, wherein the drive motor (1, 1') is flange-mounted directly to the reduction transmission (3) without interposition of a motor coupling.

8. The system arrangement of claim 1, wherein the rotor ring gear (22) is held in an uncoupled position via compression springs (24) and is displaceable in a direction toward the stator ring gear (20) to a coupled position, actuating the motor locking assembly (5, 5').

9. The system arrangement of claim 1, wherein the freewheel (6) is integrated into the reduction transmission (3).

10. The system arrangement of claim 9, wherein the freewheel (6) is arranged selectively on an input shaft (7), an intermediate shaft (8) or an output shaft (9) of the reduction transmission (3).

11. The system arrangement of claim 10, wherein a cable drum joint connection (10, 10') is provided between the output shaft (9) of the reduction transmission (3) and the at least one cable drum (2, 2'), and the freewheel (6) is integrated into the cable drum joint connection (10, 10').

12. The system arrangement of claim 1, wherein the at least one safety brake (4, 4') is arranged in two independent control circuits (26, 27).

13. A method of operating the system arrangement of claim 1, comprising activating the motor locking assembly immediately after electrical deceleration of the at least one drive motor to a rotary speed of zero.

* * * * *